US007900314B2

(12) United States Patent
Damrath et al.

(10) Patent No.: US 7,900,314 B2
(45) Date of Patent: Mar. 8, 2011

(54) DEVICE FOR DRYING OR WETTING A MOP

(75) Inventors: Joachim Damrath, Bachhagel (DE); Markus Spielmannleitner, Ellwangen (DE); Gerhard Wetzel, Sontheim (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1033 days.

(21) Appl. No.: 11/662,376

(22) PCT Filed: Aug. 26, 2005

(86) PCT No.: PCT/EP2005/054216

§ 371 (c)(1),
(2), (4) Date: Mar. 9, 2007

(87) PCT Pub. No.: WO2006/027318

PCT Pub. Date: Mar. 16, 2006

(65) Prior Publication Data

US 2007/0226942 A1 Oct. 4, 2007

(30) Foreign Application Priority Data

Sep. 9, 2004 (DE) ..... 10 2004 044 026

(51) Int. Cl.
*A47L 13/58* (2006.01)

(52) U.S. Cl. ..... 15/260

(58) Field of Classification Search ..... 15/260, 15/264

See application file for complete search history.

(56) References Cited

FOREIGN PATENT DOCUMENTS

| | | | |
|---|---|---|---|
| DE | 1 728 118 | A1 | 2/1972 |
| DE | 93 07 792 | U1 | 8/1993 |
| DE | 100 65 373 | A1 | 7/2002 |
| DE | 100 65 412 | A1 | 7/2002 |
| EP | 1219225 | A1 * | 7/2002 |
| EP | 1374752 | A2 * | 1/2004 |
| JP | 2004-89297 | A * | 3/2004 |

OTHER PUBLICATIONS

Computer Generated English Translation of EP 1219225 A1, Jul. 2002, Wetzl et al.*

* cited by examiner

*Primary Examiner* — Laura C Guidotti
(74) *Attorney, Agent, or Firm* — Laurence A. Greenberg; Werner H. Stemer; Ralph E. Locher

(57) ABSTRACT

A device for drying and/or wetting a mop with a removable container for receiving a liquid. The device has a receiver for the container with a collecting base which is located underneath the container when the container is disposed in the receiver, and the device has liquid conveying devices for removing or feeding the liquid. The collecting base extends underneath the liquid conveying devices. The liquid conveying devices have a motor for driving a pump for wetting the mop with liquid from the container and for driving a drying device for removing liquid from the mop. The drying device and the motor are fixedly connected to the device and the pump is arranged in the container. The pump is operatively connected to the motor via a separable coupling in a driving manner.

27 Claims, 4 Drawing Sheets

DEVICE FOR DRYING OR WETTING A MOP

BACKGROUND OF THE INVENTION

Field of the Invention

This invention relates to a device for wetting and/or drying a mop with a container for receiving a liquid.

DE10065369 discloses a device for wetting and drying a mop with an absorbent sponge, the device having a nozzle for wetting the mop and a roller device for squeezing out the sponge. The device comprises, as a supporting foot, a bucket-shaped container for receiving the cleaning liquid on which rest all the components of the device.

WO 97/49327 also discloses a device for rinsing out the sponge of a mop, the device being arranged at the top of a container for the washing liquid. The device may also be provided with an outlet for the liquid.

Both the aforementioned devices suffer from the disadvantage that it is necessary to dismantle the device in order to empty the container, with the possibility of liquid dripping out of the device onto the floor. On the other hand, an outlet for emptying the container has the disadvantage of increasing the cost.

SUMMARY OF THE INVENTION

The object of this invention is to provide a device for wetting and/or drying a mop, where the container can be easily filled and emptied without the possibility of liquid dripping out of the device onto the floor.

This object is achieved according to the invention by a device with the features of claim 1. The dependent claims each define preferred and advantageous embodiments of this invention.

According to the invention the container for receiving the liquid is removably accommodated in a receiver in the device, the receiver having a collecting base which is located underneath the container when the container is arranged in the device.

Due to the removable container the liquid can be supplied or emptied much more easily because only the container need be removed without the rest of the device. Since even the use of a little liquid in such devices is sufficient, very good manageability can in this case be achieved due to the removable container.

All devices for removing liquid from the container or for feeding liquid into the container necessarily open into the container, which means that the liquid can generally only drip down unintentionally at these points, so that a collecting base arranged under the container is able to receive the dripping liquid when the container is removed and only has a very small space requirement since the collecting base need not project from the base surface of the container for this purpose.

The collecting base is preferably designed so that it is at least able to receive the quantity of liquid which drops onto the collecting base during normal use. Here consideration may be given to how often, on average, the container is removed before termination of use and before the device is cleaned. In this case the collecting base may have a recess in which the liquid that drips onto the collecting base accumulates. Furthermore, the collecting base extends at least over the points at which liquid drips down when the container is removed.

The collecting base may serve as a surface for depositing the container. However, it is also possible to design the receiver and the container so that the container can be pushed in and pulled out on sliding surfaces, which may also form part of the collecting base. If the sliding surfaces form part of the collecting base, provision may preferably be made for the liquid not to reach the sliding surfaces when it drips onto the collecting base, so that the container cannot be wetted from the outside. The use of sliding surfaces has the fundamental advantage that the collecting base is not scratched and, moreover, special materials with a reduced coefficient of friction can be used in the region of the sliding contacts between the device and the container, and so that the sliding in and pulling out of the container can be facilitated.

The device may have a wetting device for wetting a mop which removes liquid from the container for this purpose. To this end at least one part of the wetting device must necessarily open into the container in order to be able to suck in liquid from there. Similarly, in the case of a drying device which removes liquid from the mop and feeds it into the container, a part may project into the container. In order not to obstruct the removal of the container provision may be made for the parts of a wetting device or a drying device projecting into the container to be movable at least so far in one direction from the container that the container can be removed. Here only the parts projecting into the container or the entire wetting or drying device can be moved. The moving part of the wetting or drying device may in this case be connected displaceably or rotatably to the device.

The space in the container may also advantageously be used for receiving at least a part of a wetting device or drying device, so that the dimensions of the device can be reduced.

In an advantageous design, the device has a motor which has a wetting device and a drying device, the wetting device comprising a pump which sucks in liquid inside the container and feeds it to a spray nozzle for wetting the mop. The drying device is arranged above the container and is fixedly connected to the device. The pump is here advantageously arranged at least partially in the container and is connected displaceably and/or rotatably to the device. The motor is connected by a shaft or other means for the transmission of force with the pump and the drying device. Depending on whether the motor is connected fixedly or movably to the device, either the connection to the pump or to the drying device must allow a relative movement between the motor and the pump or the drying device.

In an advantageous design the pump is arranged fully, and the motor arranged at least partially in the container, the motor is connected fixedly to the pump and the motor and pump can together be moved and preferably tilted with respect to the device. The motor and pump are together rotatable about the axis of the worm wheel, so that the pump, with the motor, can be moved in one direction out of the container. Here the motor may be arranged between the pump and the drying device so that the pump is close to the container base.

In an alternative design the motor is arranged fixedly in relation to the device so that the connection between the motor and the pump must allow a relative movement.

The container preferably has a handle for pulling and/or carrying it out of the device. Furthermore, the container may have a spout for pouring out the liquid.

In the device the container may also be protected against unintentional removal from the device by means of an interlock. Moreover, the device may be provided with a sensor which checks whether the container is located in the device in the space provided for it, a control system of the device being set up so that the wetting or drying device can only be put into operation when the container is in its correct position.

If parts of the wetting or drying device have to be previously moved to remove the container, an interlock may be provided which retains the container in the device until the parts to be moved have been brought into a position which enables the container to be removed. Furthermore, the movement of these parts of the wetting or drying device to be moved may also be combined with the removal movement of the container. For this purpose provision may be mad for the container to be moved a little even during movement of the parts of the wetting or drying device. Provision may also be made for the parts of the wetting or drying device that have to be moved to be moved during a movement of the container.

An exemplary embodiment of the invention is represented purely diagrammatically in the drawings and is described in greater detail below: In the drawings:

DESCRIPTION OF THE PREFERRED EMBODIMENTS

Figure 1:
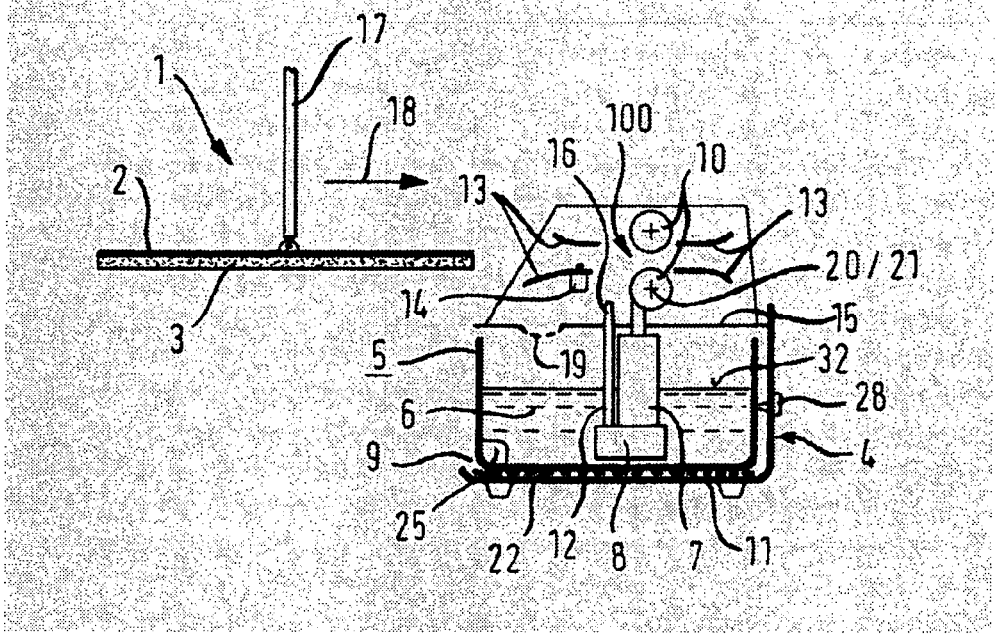
FIG. 1 shows a diagrammatic side view of a device according to the invention for wetting and drying a mop.

Device 4 shown in FIG. 1 is used for wetting and drying a mop 1, which has at the bottom, on a handle 17, an extensive holder 2 to which is secured a sponge 3 at the bottom. Sponge 3 consists of an absorbent material for absorbing a liquid 6 which is held in a container 5 in device 4.

For cleaning floor surfaces in particular sponge 3 is wetted with liquid 6 and the surface to be cleaned is wiped with it. Sponge 3 of mop 1 can then be washed out by means of device 4 to remove the dirt that has been absorbed, a defined wetting of sponge 3 being set by partial squeezing out.

For this purpose device 4 is provided with a wetting device which comprises a pump 8 and a liquid line 12. Pump 8 is arranged inside container 5 a short distance from its base. Pump 8 is connected on the outlet to liquid line 12, which leads upwards and terminates in a spray nozzle 16 aligned vertically upwards, which nozzle runs through a preferably horizontally aligned intermediate base 15. Intermediate base 15 is arranged above container 5 and is a fixed component of device 4.

A motor 7 for driving pump 8 is arranged above pump 8. Motor 7 also drives a drying device 100, which is mounted above intermediate base 15. Drying device 100 comprises two rolls 10, which are arranged one above the other and are rotatable about a horizontal axis, and the lower roller of which can be driven by motor 7 in the direction of rotation. Upper roller 10 has a split design and has two partial rolls aligned coaxially relative to each other and are separated axially from each other so that handle 17 of mop 1 can be guided through between the two partial rolls. Holder 2, together with sponge 3, is guided through between the upper and lower roll 10. The distance between upper roll 10 and lower roll 10 is dimensioned so that sponge 3 is compressed when mop 1 is guided through, then dried to a certain residual wetness.

Rolls 10 are driven so that holder 2 is pulled through with sponge 3 in the plane of drawing in a driving direction from left to right. Here sponge 3 passes through spray nozzle 16 of liquid line 12 before being squeezed between rolls 10, which line is arranged to the left of the rolls, i.e. it is arranged in the direction of movement 18 in front of rolls 10. Here motor 7 is actuated by a control device, not shown, which is connected to a switch 14 which detects the presence of holder 2 in guides 13 in the direction of driving in front of rolls 10. Guides 13 for holder 2 are also arranged in the driving direction behind rolls 10.

As soon as switch 14 responds, motor 7 is actuated by the control device, whereupon pump 8 sucks in liquid 6 from container 5 and conveys it upwards through liquid line 12. At the same time rolls 10 rotate and move holder 2 in the driving direction as soon as rolls 10 have detected holder 2. Since holder 2 is guided with sponge 3 in front of rolls 10 via spray nozzle 16, dirt in sponge 3 is washed out with liquid 6 before excess liquid 6 is squeezed out between rolls 10. Liquid 6 squeezed out by rolls 10 flows downwards onto intermediate base 5 and is fed on it, by a suitable gradient of intermediate base 15, to a filter 19 through which liquid 6 flows back down into container 5.

Device 4 also has a receiver 9 for container 5, receiver 9 being delimited upwards by the underside of intermediate base 15. Receiver 9 is open towards the left (FIGS. 1 and 2) so that container 5 can be removed from receiver 9 from the left. Receiver 9 is delimited at the bottom by a collecting base 11, which is designed in the shape of a tank and serves as a support for container 5.

In order to be able to remove container 5 from receiver 9, motor 7, pump 8 and liquid line 12 are together connected rotatably to device 4 as a pivoted unit. The pivoted unit may here be rotated about a pivoting axis 21 which coincides with the rotating axis 20 of lower roll 10. The connection between motor 7 and lower driven roll 10 is made by a worm wheel which rests on the axis of lower roll 10 and engages with a worm which sits on a vertically running shaft of motor 7. In this manner the pivoted unit can be rotated without breaking the operative connection between motor 7 and rolls 10. If the unit is pivoted with a stationary motor 7, lower roll 10 is also rotated about the pivoting angle.

Motor 7 can be prevented from pivoting about pivoting axis 21 by means of a locking device relative to device 4 so that when motor 7 is in operation the force can be transmitted to the worm wheel without the pivoted unit being pivoted due to the rotation of motor 7. Furthermore, this locking device is connected to the control device so that motor 7 can only be operated when the pivoted unit is locked.

Container 5 can be locked by means of a further locking device 26 in receiver 9, where locking device 26 of container 5 can be coupled to the locking device of the pivoted unit so that only one actuating element need be actuated to lock and release both container 5 and the pivoted unit.

Figure 2:
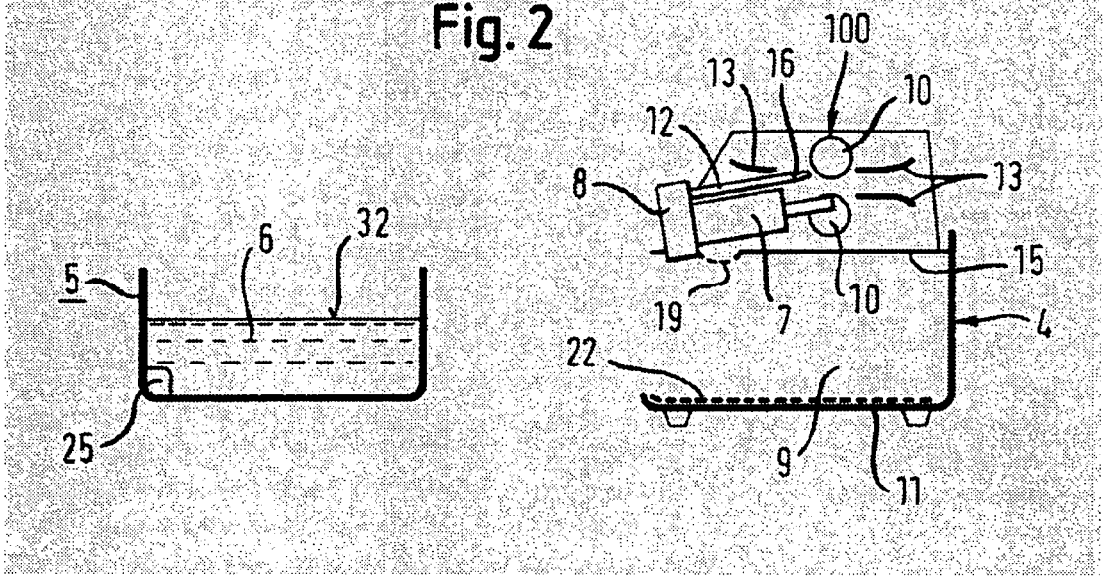
FIG. 2 shows the device shown in FIG. 1 without a mop, with the container removed from it.

FIG. 2 shows device 4 with container 5 removed. Here the pivoted unit, comprising motor 7, pump 8 and liquid line 12, is released and pivoted so far upwards that container 5 under the pivoted unit can be pulled out of receiver 9. Here the pivoted unit can also be locked in the upwardly pivoted position for simpler removal of container 5.

In the position shown in FIG. 2 the control device prevents the operation of motor 7 in order to prevent uncontrolled movement of the pivoted unit. The removed container 5 can be caused to fill to a liquid connection, such as a water cock, or to drain the liquid to an outlet.

Due to the removable container 5 liquid 6 can be changed much more easily, so that liquid 6 can be changed frequently during a cleaning process and the cleaning result can therefore be improved, since a liquid 6 loaded with less dirt, on average, is used.

Container 5 is preferably made from a transparent or translucent material so that cleaning liquid level 32, and possibly also the degree of contamination of the cleaning liquid can be observed.

A moisture absorbing device 22, such as a sponge cloth, non-woven fabric or the like, can be arranged in receiver 9 of container 5 so that when container 5 is removed, cleaning liquid dripping down from pivoted pump 8 or spray nozzle 16 or rolls 10 can be absorbed.

Figure 3:
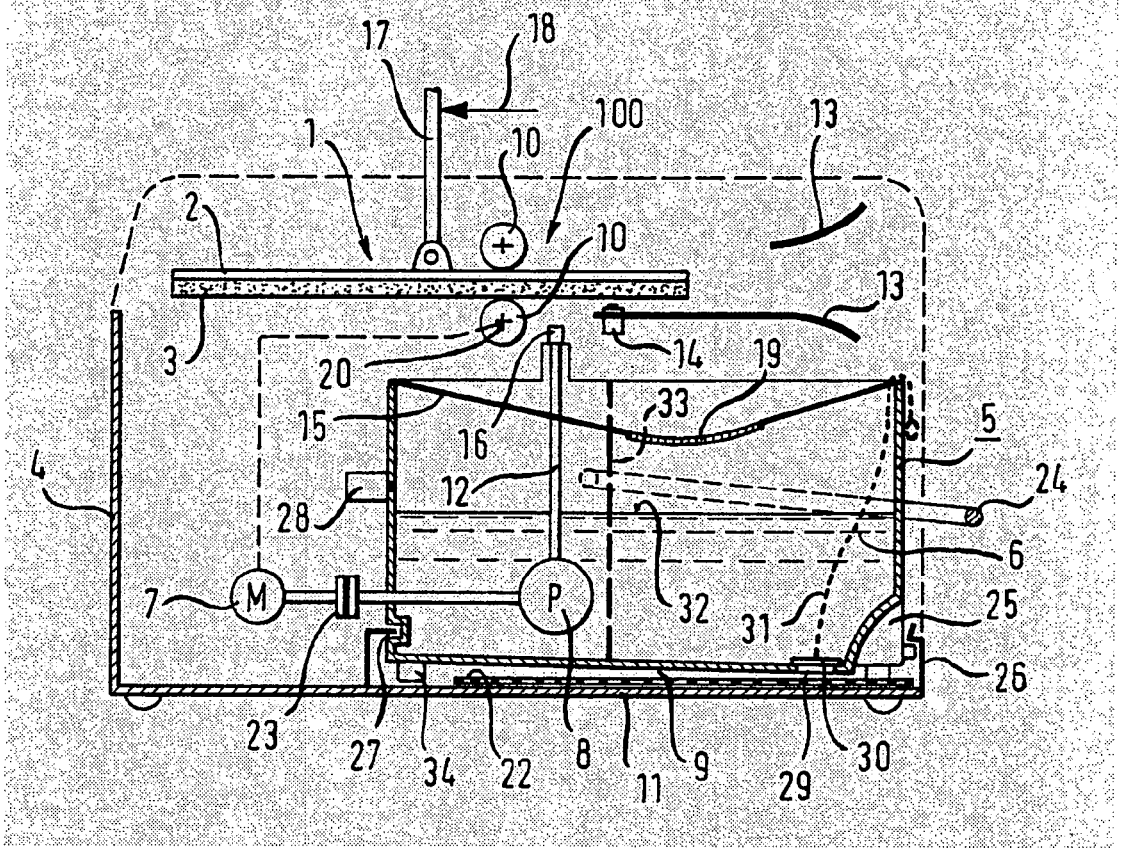
FIGS. 3 to 5 show modifications of the exemplary embodiment according to FIGS. 1 and 2.

FIG. 3 shows a modification of the embodiment shown in FIGS. 1 and 2. Only the differences are therefore explained below, the same reference symbols denoting the same objects. In this modification pump 8, liquid line 12 and spray nozzle 16 remain in container 5. The pump is connected releasably by a coupling 23 to motor 7. The coupling is located outside container 5 in device 4. Motor 7 is operatively connected to lower roll 10 and drives it. Coupling 23 is engaged when container 5 is positioned in receiver 9. Coupling 23 is disengaged when container 5 is removed from receiver 9. Coupling 23 may be designed as a coupling that is held in place by friction or as a positive coupling. When coupling 23 is designed as a positive coupling it is preferably fitted with centring devices to facilitate engagement. Coupling 23 is designed extremely advantageously as a Velcro zip. If coupling 23 is designed as one that is held in place by friction, the coupling may be engaged by a spring which presses the parts of coupling 23 together when container 5 is inserted.

In the modification according to FIG. 3 filter 19 and intermediate base 15 are arranged in container 5 so that they can be removed. Container 5 has a moving handle 24 and a handle trough 25 arranged on the rear, lower end of container 5. With handle 24 and handle trough 25 container 5 can easily be removed from device 4 and inserted again, and container 5 can easily be drained when removed.

Spray nozzle 16 arranged in container 5 is preferably designed as a series of spray nozzles 16 and can be connected to feed line 12 by a rapid release snap, stop or rotary connection so that if necessary spray nozzle 16 or the series of spray nozzles 16 can easily be cleaned.

Container 5 can be locked by means of a locking device 26 and undercut 27 with receiver 9. A sensor 28 detects the proper presence of container 5 in receiver 9. Device 4 is not ready for operation until container 5 is properly positioned in receiver 9. It is therefore also checked indirectly by sensor 28 whether coupling 23 is engaged.

Since container 5 is provided with a preferably pivoted handle 24, and container 5, with receiver 9, can be connected by locking device 26 and undercut 27 to device 4, the entire device 4 can also be transported by means of handle 24.

Container 5 has in its base an opening 29 that can be tightly sealed by a seal 30 so that the cleaning liquid can also be drained through opening 29. Seal 30 of opening 29 can be opened and/or closed from outside container 5 or from above cleaning liquid level 32. This can be effected by means of a pull cord 31. Pull cord 31 is connected at one end to seal 30 and is accessible at the other end from above cleaning liquid level 32. Alternatively to pull cord 31, lever mechanics may be provided for opening or sealing opening 29.

The container may have a partition 33 for separating dirty cleaning liquid from clean cleaning liquid.

In a modification according to FIGS. 1 and 2 or FIG. 3, two containers 5 may be provided instead of one container 5, one of which is specially provided for dirty cleaning liquid and the other container for unused cleaning liquid.

Container 5 is provided on its underside with rubber feet 34 for secure positioning of container 5 in receiver 9.

Figure 4:
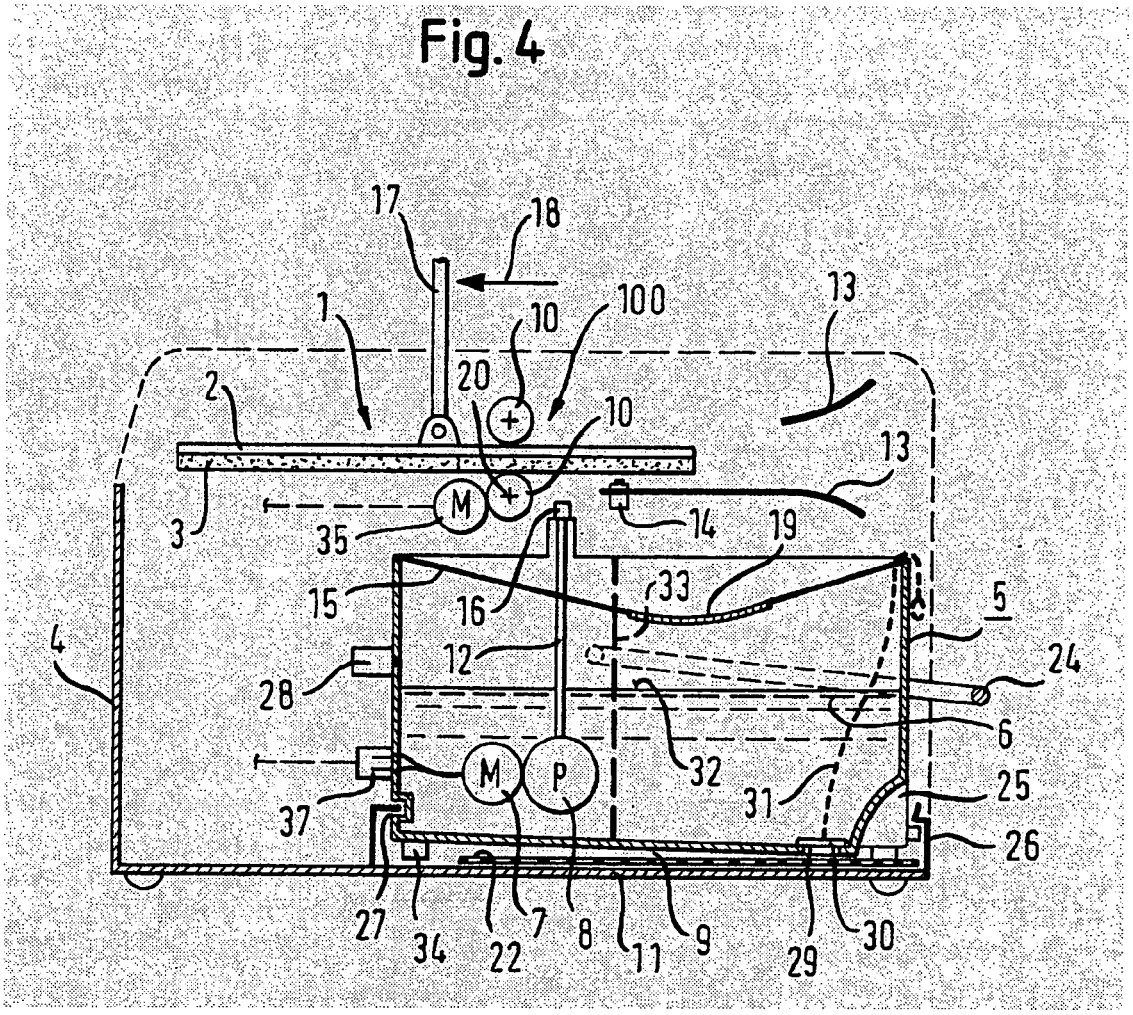

FIG. 4 shows a further modification of the embodiments described above, in which motor 7 is integrated in container 5 and is connected directly to pump 8. In order to be able to remove the container, an electrical coupling 37 is provided between device 4 and container 5. An additional motor 35 may be provided for driving rolls 10, or motor 7 arranged in container 5 is operatively connected in a driving manner to roll 10 by means of a separable transmission chain.

Figure 5:
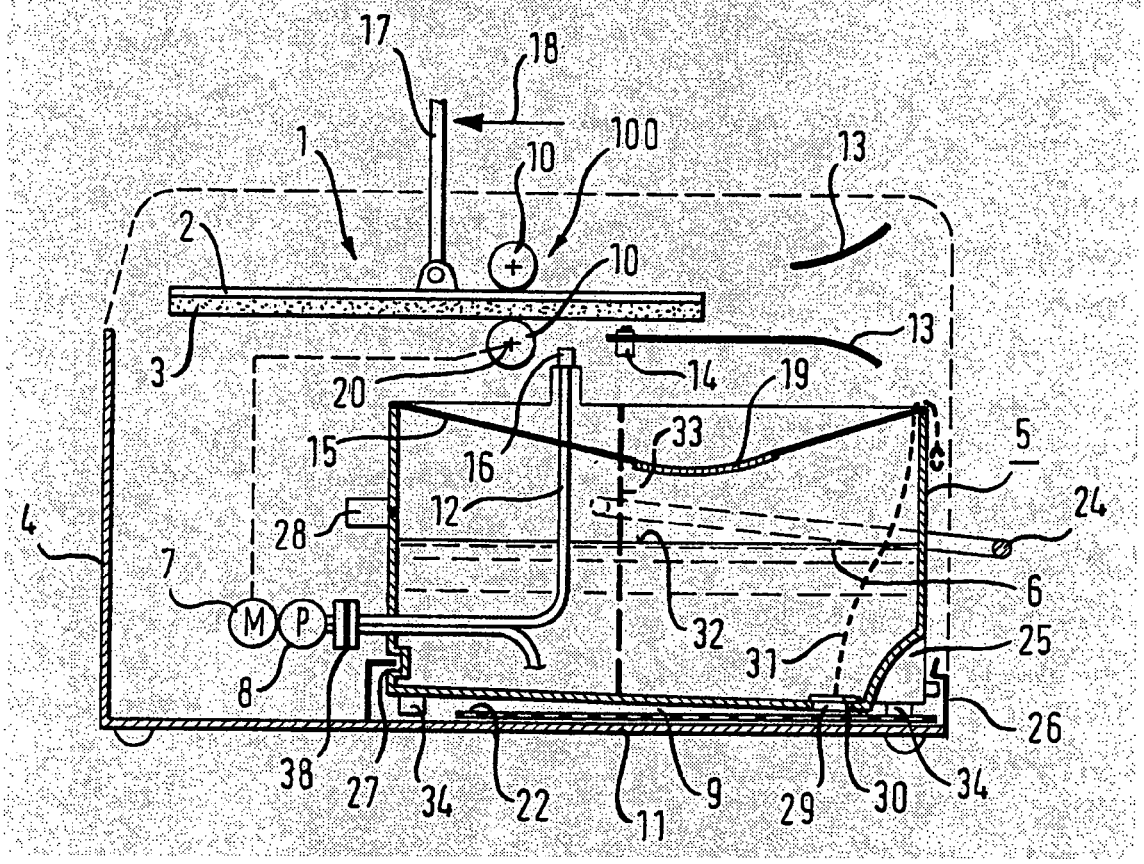

FIG. 5 shows a further modification of the embodiments described above, in which pump 8 is arranged outside container 5 in device 4, liquid line 12, arranged in container 5, and spray nozzle 16, being releasably connected by a hydraulic coupling 38 to the pump so that the container can easily be removed.

We claim:

1. A device for drying and/or wetting a mop, the device comprising:

a removable container for receiving a liquid;

a receiver for said container, said receiver having a collecting base located underneath said container when said container is disposed in said receiver;

liquid conveying devices for removing or feeding the liquid, said collecting base being disposed underneath said liquid conveying devices and said liquid conveying devices including:

a pump disposed in said container for wetting the mop with liquid from said container;

a fixedly connected drying device for removing liquid from the mop;

a fixedly connected motor for driving said pump and said drying device; and a separable coupling operatively connecting said pump to said motor;

wherein said collecting base has a replaceable, liquid-receiving device formed of a sponge cloth or fleece material.

2. The device according to claim 1, wherein said collecting base extends fully over an entire base surface of said container.

3. The device according to claim 1, wherein said pump is movably disposed into a position of repose in a direction leading from said container, and wherein, in the position of repose, said container can be removed from said receiver.

4. The device according to claim 3, wherein said pump is mounted for raising or rotating into the position of repose.

5. The device according to claim 1, wherein said drying device is fixedly connected to the device and said pump is mounted for movement in one direction out of said container.

6. The device according to claim 1, wherein said motor and said pump are mounted to be commonly moved relative to the device.

7. The device according to claim 1, wherein said coupling is separable by removing said container from said receiver and connectible by inserting said container into said receiver.

8. The device according to claim 1, which further comprises a sensor for detecting a position of said container inside said receiver, ensuring that the device is only operable when said container is disposed in said receiver.

9. The device according to claim 1, which further comprises a locking device for locking said container in said receiver.

10. A device for drying and/or wetting a mop, the device comprising:

a removable container for receiving a liquid;

a receiver for said container, said receiver having a collecting base located underneath said container when said container is disposed in said receiver;

liquid conveying devices for removing or feeding the liquid, said collecting base being disposed underneath said liquid conveying devices and said liquid conveying devices including:

a pump disposed in said container for wetting the mop with liquid from said container;

a fixedly connected drying device for removing liquid from the mop;

a motor disposed in said container together with said pump, for driving said pump and for driving said drying device; and a separable electrical coupling connecting said motor to the device; and wherein said collecting base has a replaceable, liquid-receiving device formed of a sponge cloth or fleece material.

11. The device according to claim 10, wherein said collecting base extends fully over an entire base surface of said container.

12. The device according to claim 10, wherein said pump is movably disposed into a position of repose in a direction leading from said container, and wherein, in the position of repose, said container can be removed from said receiver.

13. The device according to claim 12, wherein said pump is mounted for raising or rotating into the position of repose.

14. The device according to claim 10, wherein said drying device is fixedly connected to the device and said pump is mounted for movement in one direction out of said container.

15. The device according to claim 10, wherein said motor and said pump are mounted to be commonly moved relative to the device.

16. The device according to claim 10, wherein said electrical coupling is separable by removing said container from said receiver and connectible by inserting said container into said receiver.

17. The device according to claim 10, which further comprises a sensor for detecting a position of said container inside said receiver, ensuring that the device is only operable when said container is disposed in said receiver.

18. The device according to claim 10, which further comprises a locking device for locking said container in said receiver.

19. A device for drying and/or wetting a mop, the device comprising:

a removable container for receiving a liquid;

a receiver for said container, said receiver having a collecting base located underneath said container when said container is disposed in said receiver;

liquid conveying devices for removing or feeding the liquid, said collecting base being disposed underneath said liquid conveying devices and said liquid conveying devices including:

a pump disposed in said container for wetting the mop with liquid from said container;

a drying device for removing liquid from the mop;

a motor for driving said pump and said drying device, said pump, said drying device, and said motor being fixedly connected to the device; and a liquid line for wetting the mop fixedly disposed in said container; and a separable hydraulic coupling connecting said pump connected to said container and said liquid line.

20. The device according to claim 19, wherein said collecting base extends fully over an entire base surface of said container.

21. The device according to claim 19, wherein said pump is movably disposed into a position of repose in a direction leading from said container, and wherein, in the position of repose, said container can be removed from said receiver.

22. The device according to claim 21, wherein said pump is mounted for raising or rotating into the position of repose.

23. The device according to claim 19, wherein said drying device is fixedly connected to the device and said pump is mounted for movement in one direction out of said container.

24. The device according to claim 19, wherein said motor and said pump are mounted to be commonly moved relative to the device.

25. The device according to claim 19, wherein said hydraulic coupling is separable by removing said container from said receiver and connectible by inserting said container into said receiver.

26. The device according to claim 19, which further comprises a sensor for detecting a position of said container inside said receiver, ensuring that the device is only operable when said container is disposed in said receiver.

27. The device according to claim 19, which further comprises a locking device for locking said container in said receiver.

* * * * *